US005740935A

United States Patent [19]

Desfarges

[11] Patent Number: 5,740,935

[45] Date of Patent: Apr. 21, 1998

[54] BUNG HOLE PLUG

[75] Inventor: Laurent A. Desfarges, Durbanville, South Africa

[73] Assignee: Idaho Bung Co., Inc., Boise, Id.

[21] Appl. No.: 629,767

[22] Filed: Apr. 9, 1996

Related U.S. Application Data

[63] Continuation of Ser. No. 369,528, Jan. 5, 1995, abandoned.

[51] Int. Cl.[6] ..... B65D 39/12

[52] U.S. Cl. ..... 217/110; 217/108; 220/236; 220/235; 215/360; 215/361

[58] Field of Search ..... 217/98, 108, 110; 220/235, 236, 233, 234; 215/360, 361, 358

[56] References Cited

U.S. PATENT DOCUMENTS

| | | | |
|---|---|---|---|
| 145,897 | 12/1873 | Pentlarge | 217/98 |
| 303,558 | 8/1884 | Cambell | 220/235 |
| 1,907,120 | 5/1933 | Rishel | 217/110 |
| 2,146,382 | 2/1939 | Rice | 217/98 |
| 2,566,816 | 9/1951 | Work | 220/235 |
| 2,831,619 | 4/1958 | Cowie | 220/235 X |
| 2,905,355 | 9/1959 | Orser | 220/235 |
| 2,993,616 | 7/1961 | Carlile | 220/235 |
| 3,443,716 | 5/1969 | Evans | 220/235 |
| 5,109,997 | 5/1992 | Phillips | 215/360 X |
| 5,184,698 | 2/1993 | Coffenberry | 220/235 X |

FOREIGN PATENT DOCUMENTS

| | | | |
|---|---|---|---|
| 219718 | 8/1995 | Australia | 217/98 |
| 74828 | 8/1995 | France | 215/360 |
| 500042 | 8/1995 | Germany | 220/236 |

*Primary Examiner*—Stephen J. Castellano
*Attorney, Agent, or Firm*—Frank J. Dykas

[57] ABSTRACT

A bung hole plug formed of resilient synthetic material interfitted between a front and back plate. A threaded post is attached to the back plate, and used, in conjunction with a lock washer and nut, to draw the front and back plates together, thereby squashing the resilient plug against the side walls of the bung hole to maintain a fluid tight seal.

3 Claims, 2 Drawing Sheets

BUNG HOLE PLUG

This application is a continuation of application Ser. No. 08/369,528, filed Jan. 5, 1995 now abandoned.

BACKGROUND OF THE INVENTION

1. Technical Field

This invention relates to bung hole plugs and more particularly to a compressively adjustable, resilient bung hole plug.

2. Background

The arts of the cooper vintner, brewer and distiller, are admittedly old and well developed as fine arts indeed. Some of their products are aged for years in wooden casks and barrels to enhance color, body, aroma and flavor. The hole through which a barrel or cask is filled or drained, is called the bung hole. It is plugged with a bung hole plug.

Distilled spirits, from which fine whiskeys and other spirits are made, are usually colorless and tasteless as they are drawn off as condensate from the still. It is the material from which the barrel or cask is made and the contaminants contained therein which add body, aroma, and ultimately flavor to the spirits.

The same is generally true with winemaking. The freshly pressed grape juices often have a sweet and sometimes bitter raw taste, which needs to be developed during aging within the cask or barrel. As a result, vintners and distillers pay particular attention to the material from which their casks and barrels are made, and at least in the case of distilled spirits, the use to which the cask was previously put. Bung hole plugs, in the prior art, are preferably made from the same material and put to the same prior uses as the original casks and barrels. Thus, in the prior art, if a cask is made from oak, preferably its bung hole plug will be made from oak. This is done to avoid contamination of the body, aroma and flavor which is detectable to the discerning palette of a consumer.

The problem is that the cooper's trade, however ancient, is not an exact science, and bung holes vary in size from cask to cask and barrel to barrel. For this reason, prior art bung hole plugs are formed in the shape of a frustrum or tapered cone. As a result, when inserted in a bung hole, they stick out from the side surfaces of the barrel staves, and are subject to being knocked loose if the barrel is rolled or otherwise repositioned. Additionally, oak bung plugs can leak, and are subject to dry rot and other microbial contamination. Cork and synthetic materials are not suitable substitutes, since they can alter the aroma and flavor of the aging product. One synthesized product which has been found to be a suitable substitute for the traditional oak or natural wood bung plug, is the plug made of silicone polymers.

In the prior art, traditionally shaped frustrum or tapered cone-shaped bung plugs have been formed of silicone polymers in an attempt to use them as acceptable substitutes for the natural material bung plug. These are shaped identically to the original wooden products, like wooden bung plugs, and are tapered cones which are simply pounded into the bung in the same manner as has been done for literally hundreds of years.

The problem with the prior art silicone polymer bung plug is that it does not necessarily always form a fluid-tight seal, and is subject to be jarred or knocked loose during handling of the cask or barrel, and sometimes even pushed out or ejected from the bung hole by a pressure differential between the contents of the barrel and atmosphere. While the acceptable food grade synthetic materials are generally resilient when they are shaped as a tapered plug, they are difficult to hold in fluid-tight compressive seal within a bung hole. The reason is that the size of the bung hole will change over time, due to various factors such as absorption of fluid from the stored contents, storage temperatures and moisture conditions and the tapered plug will not. As a result, it may become loose and the fluid tight seal may be broken.

Accordingly, what is needed is a bung hole plug formed of synthetic material, not subject to rot or contamination or transfer of undesirable flavors or aromas, which can be held in watertight seal within a bung hole formed of a natural material such as oak, which is subject to size variations due to changing environmental conditions. It is also an object of this invention to provide a bung hole plug that fits flush with surfaces of the barrel staves such that the barrel can be rolled or moved without the plug being jarred or knocked loose.

DISCLOSURE OF INVENTION

These objects are achieved by the use of a bung hole plug formed of a resilient, synthetic material plug, which is held in over compression and fluid tight seal against the walls of the bung hole. The bung hole plug is formed of a resilient plug, a back plate with an attached, normally extending threaded post, and a front plate which are squeezed together by the action of a threaded nut on the post to over compress and thereby squash the resilient plug against the side walls of the bung hole. Thus, as the bung hole becomes larger due to cask or barrel material shrinkage, the resilient plug, being in an over compressed state, can expand to maintain a fluid tight seal. In a like manner, as the material from which the cask or barrel is made expands to the fluid absorption or temperature change, the resilient plug is able to give so as to prevent its ejection from the bung hole, or a breakage of the cask or barrel material.

The front plate of the bung hole plug is provided with a lip and a nut receiving recessed area, such that when installed, it fits nearly flush with the surface of the barrel staves, thus minimizing the risk that it will be knocked or jarred loose when the barrel or cask is moved or rolled.

BEST MODE FOR CARRYING OUT INVENTION

Figure 1:
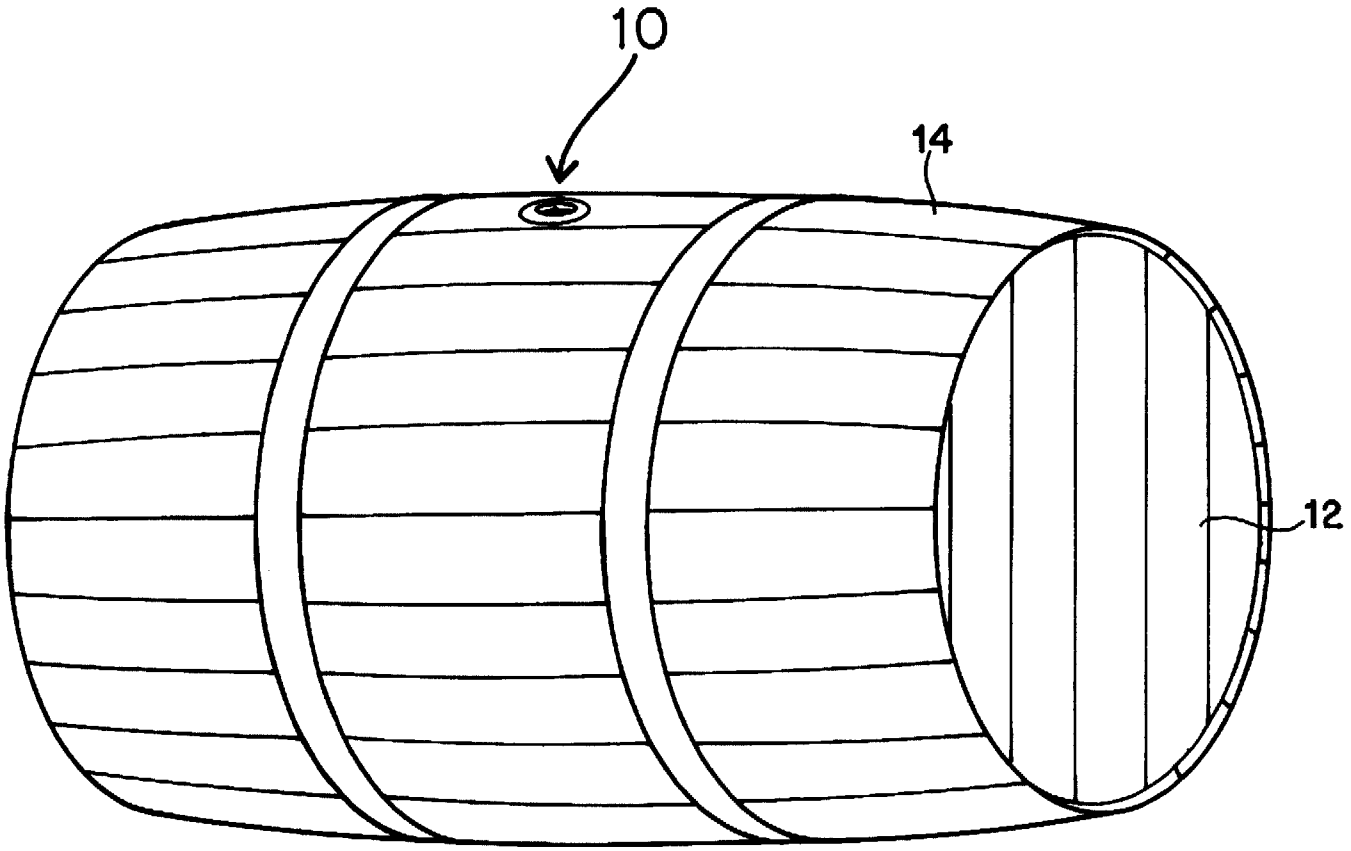
FIG. 1 is a perspective representational view of a cask or barrel.
Figure 2:
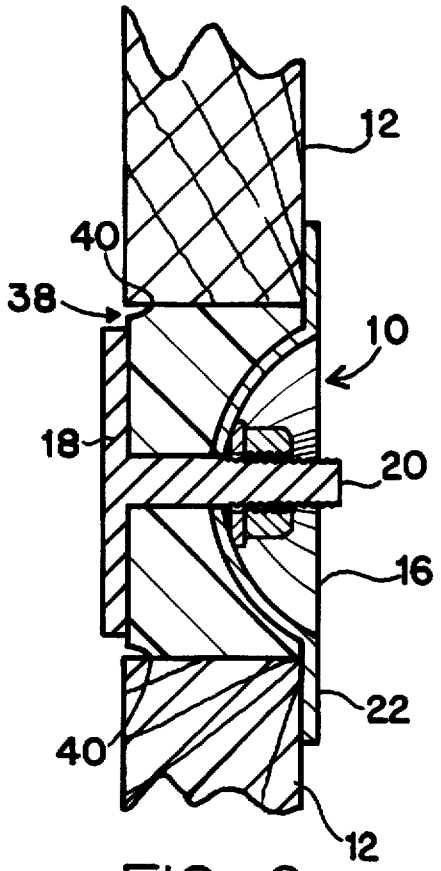
FIG. 2 is a sectional side view of the bung hole plug inserted within a bung hole.
Figure 3:
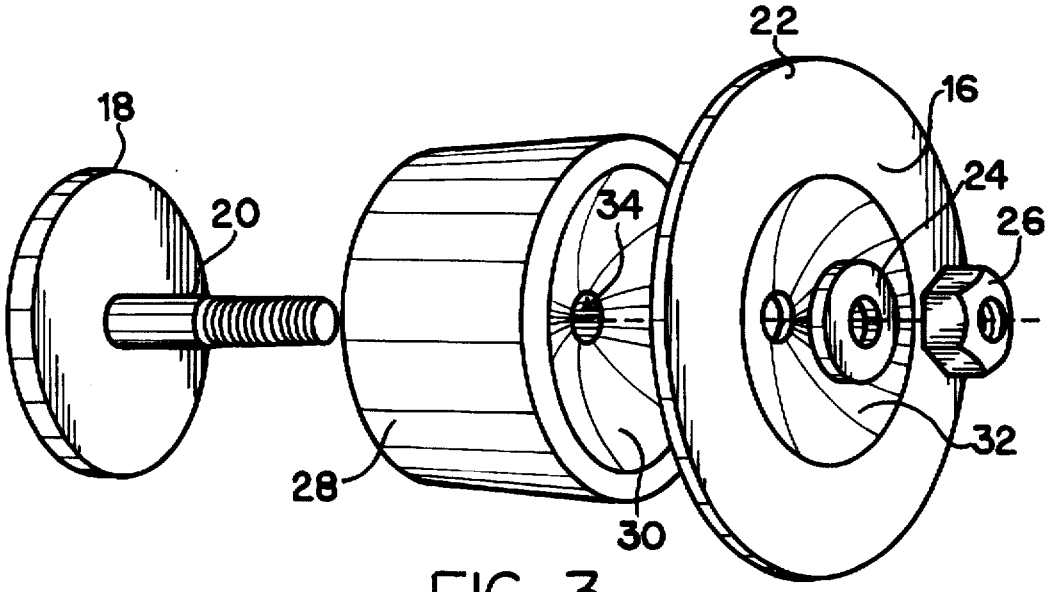
FIG. 3 is an exploded perspective representational view of the bung hole plug.

FIG. 1 shows a traditional wooden cask or barrel 12 having barrel end 14 and my new bung hole plug 10 installed within a bung hole. FIGS. 2 and 3 show my new bung hole plug 10 in more detail.

Bung hole 10 is formed of face plate 16, resilient plug 28, and back plate 18 which has an attached threaded post 20 which interfits through a resilient plug hole 34 and face plate hole 36. Washer 24 and threaded nut 26 are provided to draw back plates 18 and face plates 16 together to place resilient plug 28 into compression in order to form a compressive fit between resilient plug 28 and surface walls 40, bung hole 38 and barrel end 12.

In the preferred embodiment, a food-grade silicone polymer is used as the material of choice for resilient plug 28.

Preferably, it is a material such as produced by General Electric Corporation's Silicone Division and known as Silplus Elastomors, such as product model nos. SE6035 and SE6075. Silplus is claimed as a trademark for a General Electric company. This product, and other's silicon polymers, typically have a durometer A hardness of between 30 and 70, and are resistant to tear and shrinkage, with linear shrinkage over aging of less than 5.5%. In addition, they are resistant to oil, moisture and temperature variations.

To aid in the deformation necessary to compress resilient tapered plug 28 into a compressive fit against the side walls 40 of bung hole 38, is further facilitated by the shape in which resilient plug 28 is formed. It is provided with a concave plug portion 30, into which interfits concave face plate portion 32. Then, when nut 26 is threaded on to threaded post 20, to draw face plate 16 and thereby resilient plug 28 into compressive engagement against back plate 18, the side walls of resilient plug 28 expand outward into engagement with side walls 40 of bung hole 38.

Backplate 18 is sized so that it will easily interfit within bung hole 38. Face plate 16 is sized and has formed integral therewith lip 22 which is sized to engage the barrel end wall 12 surrounding bung hole 38 so as to prevent bung hole plug 10 from being fully inserted through bung hole 38. The fit is nearly flush with the surface of the barrel staves, and as a result, the barrel can be rolled, or otherwise moved without jarring or knocking bung hole plug 10 loose.

Nut 26 is drawn down on the threaded post 20 to cause resilient plug 28 to be pushed into compressive engagement with side walls 40 of bung hole 38 to the extent that there is at least a five to ten per cent overcompression, so as to facilitate a water-tight seal of bung hole 38. Additionally, the over compression allows for natural expansion of bung hole 38 without breakage of the water-tight seal, and conversely, during shrinkage of the diametric size of bung hole 38, without breakage of the cask or barrel, or ejection of bung hole plug 10.

Face plate 16, back plate 18, threaded post 20, washer 24 and nut 26 are all formed of food-grade stainless steel and thus impart no contaminates to the stored product. In a like manner, it has been found and known in the prior art, that silicon polymers are of low toxicity and acceptable for use in storage of foods.

While there is shown and described the present preferred embodiment of the invention, it is to be, distinctly understood that this invention is not limited thereto but may be variously embodied to practice within the scope of the following claims.

I claim:

1. A bung hole plug, for use with a barrel having a cylindrical bung hole formed in a side thereof, which comprises:

a resilient, tapered, cylindrical plug, having a smaller end and a larger end, said larger end having a concave face portion, configured for insertion of the smaller end into the bung hole of the barrel, said cylindrical plug further having a hole formed therethrough coincident to its longitudinal axis for receiving a threaded post;

a back plate for positioning against the smaller end of the cylindrical plug;

a threaded post attached to said back plate and sized for extension through said axial hole in said cylindrical plug;

a face plate having a hole therethrough for receiving the extending end of said threaded post, said face plate having a convex central portion for interfitting engagement with the concave face portion of the cylindrical plug, said face plate further having a circumvolving lip having a planar surface for engagement with the surface of the barrel side when the resilient tapered cylindrical plug is inserted into the bung hole; and a threaded traveler nut for threaded engagement with the end of the threaded post extending through the convex portion of the face plate for drawing said face plate towards said back plate and squashing the sides of the tapered cylindrical plug against the sides of the bung hole.

2. The bung hole plug of claim 1 wherein said resilient plug is formed of a silicone polymer.

3. The bung hole plug of claim 1 where said resilient plug is formed of a silicone polymer having a hardness Durometer A rating within the range of 30 to 77.

* * * * *